United States Patent [19]

Stempel

[11] 4,437,839

[45] Mar. 20, 1984

[54] CHALKBOARD WITH HINGED CHALK RAIL

[76] Inventor: John H. Stempel, 117 N. Blanco, Coleman, Tex. 76834

[21] Appl. No.: 369,417

[22] Filed: Apr. 19, 1982

[51] Int. Cl.[3] ..... B43L 21/04

[52] U.S. Cl. ..... 434/417; 108/134

[58] Field of Search ..... 52/36; 108/134; 248/240.3, 240.4; 434/408, 411, 413, 414, 417, 419, 420, 421, 432

[56] References Cited

U.S. PATENT DOCUMENTS

| | | | |
|---|---|---|---|
| 290,789 | 12/1883 | Nagele | 108/134 X |
| 516,005 | 3/1894 | Geer | 434/432 X |
| 577,888 | 3/1897 | Thomas | 434/419 |
| 1,521,059 | 12/1924 | Weeks | 434/417 |
| 1,606,784 | 11/1926 | Hines | 434/408 |
| 1,877,669 | 9/1932 | Kitze | 434/408 X |
| 1,966,800 | 7/1934 | Katzman | 52/36 X |
| 2,115,497 | 4/1938 | Mintz | 434/432 X |
| 3,659,355 | 5/1972 | Aubin | 434/408 |

*Primary Examiner*—Harland S. Skogquist

*Attorney, Agent, or Firm*—Joseph H. Schley; Thomas L. Cantrell; Stanley R. Moore

[57] ABSTRACT

An indicia receiving board, such as a chalkboard, or marker board having a writing surface and a longitudinal folding rail hinged at its ends and projecting forwardly from the bottom of the board. The hinged arrangement provides a rail which may be folded upwardly into close proximity to the plane of the indicia receiving or writing surface and thereby permit the use of a much thinner shipping carton with an appreciably reduced internal packaging support. After a board is removed from its carton, the rail is pivoted about its end hinges to an extended transverse position generally perpendicular to the writing surface of the board and thereby provide a ledge or shelf for chalk, erasers, markers, and/or other indicia affixing and removing articles. The rail is supported in its extended position by substantially coextensive foot means projecting from the inner lower margin of the rail to engage the bottom of the board. One or more angular bracket or clip means are provided intermediate the ends of the rail for fastening said rail to the lower margin of the board to maintain the bearing of the foot member against the bottom of said board.

14 Claims, 5 Drawing Figures

CHALKBOARD WITH HINGED CHALK RAIL

BACKGROUND OF THE INVENTION

The major element in a prefabricated indicia receiving board such as a chalkboard, or marking board is the board itself which presents a substantially planar indicia receiving or writing surface. Thus, the board has height and breadth, but the framing and mounting of said board requires very little depth. The second major element of the indicia receiving board is a rail along the bottom of the board which projects from said board and which requires sufficient depth to provide a resting ledge or shelf for articles necessary or convienient for the creation, affixation, and removal of indicia from the receiving surface. Typically, the transverse depth or width of the rail is several times the depth of the framing and the board itself which presents the indicia receiving or writing surface of said board. This projection of the rail at the extreme bottom edge of the prefabricated board, substantially complicates the shipping of an otherwise planar board. This is particularly true because it is far more convenient, in shipping wholesale lots, to package in conventional, rectangular shapes. Thus, cartons for shipping individual boards have heretofore been uniform in thickness at a depth that is required to accommodate their rails. In such a uniform package, provision must be made to secure the board within the carton and to support the empty voids within the carton. These voids, necessary for the geometry of a conventional board constitute the vast majority of the volume within the carton. Without supporting these voids, stationary rails are dangerously exposed, in that, their relatively small areas otherwise support all loading across the face of the cartons. One solution is to provide support throughout the depth of a standarized container by inserting substantial volumes of interior packaging materials. However, these materials represent a significant expense and addition to shipping weight in wholesale lots.

Neither is the use of nonrigid members or partially assembled boards satisfactory.

SUMMARY OF THE INVENTION

The present invention comprises an elongate folding rail which is generally coextensive with and has its inner lower longitudinal margin hinged at either end to the bottom of an indicia receiving or writing board so as to project forwardly therefrom and form a ledge or shelf for supporting chalk, markers and/or erasers. This hinged arrangement provides a rail which may be folded upwardly substantially adjacent the plane of the writing surface of the board and thereby permits the use of a much thinner shipping carton that requires little or no internal auxiliary packaging support. The rail is well protected with less cost in packaging material and in such a manner as to substantially reduce the volume and the weight in shipping commercial lots. After an individual board has been removed from its carton, the rail is adapted to be pivoted outwardly and downwardly about its hinges to an extended position which is generally perpendicular to the board writing surface. As a result, no tools nor mounting of new parts, nor any assembly is required, yet a stable rail formed out of rigid members is provided.

The rail of the invention is well supported across its length even though it is conveniently hinged only at the opposing lower ends of the board. A substantially coextensive foot member projects generally perpendicularly from the inner longitudinal margin of the ledge or shelf for engagement with the bottom of the board to support the rail in its extended position. At least one pair of coacting bracket or clip members are adapted to fasten at least the medial or intermediate portion of the rail to the lower margin of the board in the extended position of said rail. One bracket or clip member of the pair is secured to the board lower margin, while the other bracket or clip member of said pair is mounted on the rail for latching engagement with said board so as to maintain the bearing foot member against the bottom of said board.

A BRIEF DESCRIPTION OF THE DRAWINGS

FIG. 1 is a broken-away perspective view of a chalkboard constructed in accordance with the present invention;

FIG. 2 is an enlarged transverse vertical sectional view, taken on line 2—2 of FIG. 1 in which the chalk rail is folded down and outward to its substantially horizontal position perpendicular to the board, FIG. 3 is a view, similar to FIG. 2, in which said chalk rail is folded up and inward to its upright position, FIG. 4 is a broken-away perspective view of an intermediate cross-section of said rail with the bracket members in elevation and said board in broken lines, and FIG. 5 is a broken-away perspective view of one end of a modified embodiment of the present invention.

DESCRIPTION OF A PREFERRED EMBODIMENT

The teaching of the invention is equally applicable to a variety of boards including chalkboards, marker, or other indicia receiving boards. Of course, the nature of the indicia receiving board determines the appropriate articles necessary to affix and remove the corresponding indicia. Chalkboards remain among the most common indicia receiving boards and are discussed in this application as representative of any indicia receiving board. Thus, in the preferred embodiment, indicia receiving board is a chalkboard constructed in accordance with the invention.

Figure 2:
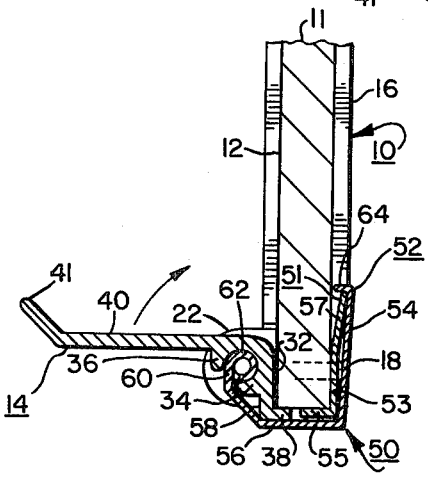
Figure 3:
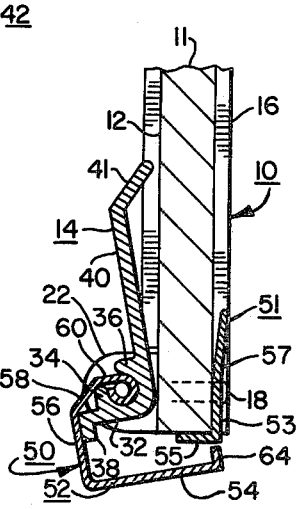

In the drawings, the lower end portion of a chalkboard 10 is shown and the mounting and structure of a horizontal chalk rail 14 are illustrated. The medial areas of the lower end portion of the chalkboard and chalk rail are broken away for purposes of illustration. Chalkboard 10 includes a board 11 having a flat writing surface 12 at its front and framed on its sides by a pair of upright frame members 16 which may be fastened to the board by suitable means, such an staples 18 (FIGS. 2, 3). Chalk rail 14 is generally coextensive with the bottom of the board and terminates at its opposing ends with end caps 15.

Figure 1:
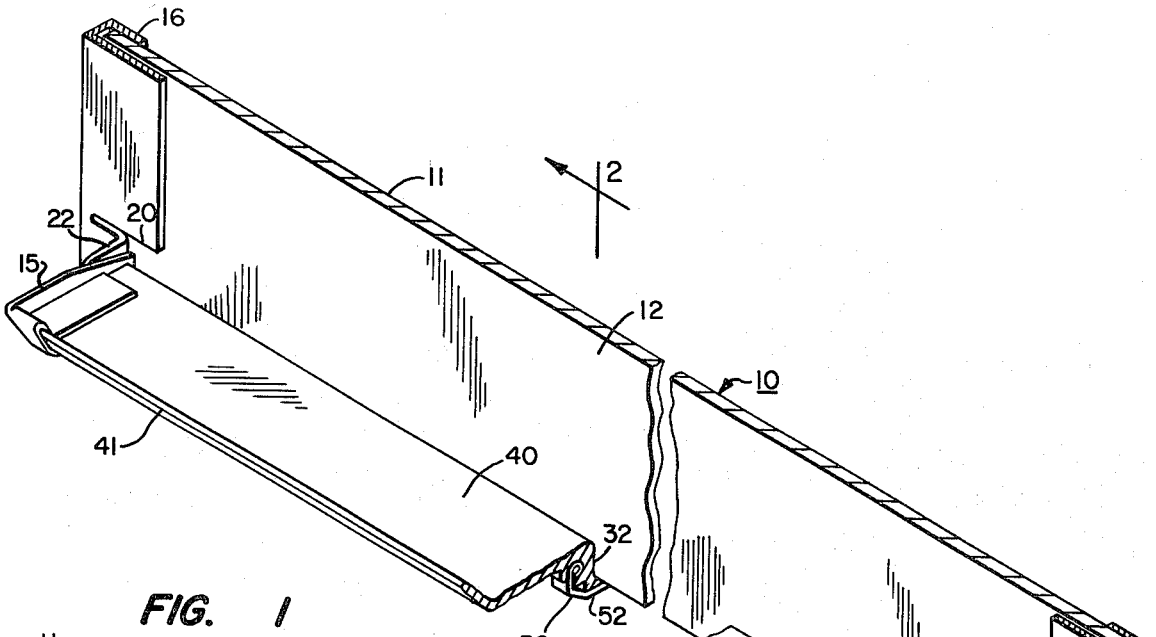

As shown in FIG. 1, the lower portion of each upright frame member 16 is cut transversely, preferably horizontally, as shown at 20 to form a flange 22 which is bent forwardly from said frame member so as to protrude perpendicularly or at a right angle relative to said frame member and function as an upright hinge member or plate. Hinge means, such as a screw or pin 30, mounts each end of chalk rail 14 to each flange or hinge plate 22 adjacent its inner longitudinal margin whereby said rail is pivotally supported. This inner longitudinal margin of the chalk rail is angular and has a coextensive leg or flange 32 extending laterally and downwardly (FIG. 2)

and/or forwardly (FIG. 3) therefrom in perpendicular or right angular relationship. A coextensive relatively narrow perpendicular flange or foot 34 projects outwardly or forwardly (FIG. 2) and/or upwardly (FIG. 3) from leg 32 parallel to elongate rectangular ledge or shelf 40 of rail 14 (FIG. 4) and in adjacent spaced relation to the inner longitudinal margin of said rail. A still narrower coextensive flange or foot 36 depends from ledge or shelf 40 in parallel adjacent relation to flange or foot 34 for coacting therewith to receive a pair of hinge pins 30 and pivotally attach said chalk rail to hinge plates 22.

In FIG. 3, the chalk rail is shown inwardly folded or pivoted to its up position with its flange or leg 32 inclined forwardly or transversely, its flange 34 upstanding or inclined upwardly, and its flange 36 inclined forwardly downwardly. For limiting the pivotal movement of rail 14, a coextensive flange or foot 38, similar to flange 36, projects laterally from the inner or free longitudinal margin of flange or leg 32 of said rail, inwardly or rearwardly below the lower margin of the chalkboard in FIG. 2, and at a downward inclination in FIG. 3, whereby foot 38 is adapted to bear against the bottom of board 11 to limit outward or opening movement of said rail and support said rail in a generally horizontal position.

A comparison of FIGS. 2 and 3 best illustrates the operation of hinged chalk rail 14, with FIG. 2 showing the chalk rail in its forwardly horizontally extended or down position. In this down position, the upper surface of rail 14 presents ledge 40 to receive and retain pieces of chalk and erasers or other applicable indicia affixing and removing means. Preferably, the front margin of the chalk rail is upwardly turned or inclined to provide a longitudinal lip 41 coextensive with the ledge or shelf. It is noted that the over-all thickness or depth of chalkboard 10 is doubled approximately when rail 14 projects from the chalkboard (FIGS. 1, 2). Obviously, this thickness is reduced by folding or pivoting the chalk rail to its upright position adjacent writing surface 12 of board 11 as illustrated in FIG. 3.

Returning to FIG. 2, this cross section shows the dual elements or means for supporting ledge 40 in its extended or horizontal position. Chalk rail 14 is adapted to pivot about hinge pins 30 and foot or flange 38 is adapted to seat against the bottom of board 11 and prevent further pivoting of said chalk rail, whereby the ledge is supported in its down position substantially perpendicular to said board. One particularly convenient fabrication method for forming rail 14 is by extrusion of lightweight metals, such as aluminum, so as to provide continuous flanges extending the entire length of said rail. Thus, foot 38 can engage the entire length of board 11 to support the chalk rail.

Figure 4:
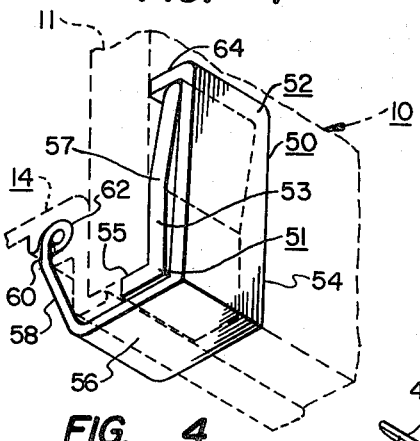

A bracket 50 is adapted to support the medial or intermediate portion of chalk rail 14 in coacting relation to hinge pins 30 at the ends of said rail. If desired, additional supporting brackets may be provided or a single supporting bracket may extend the length of the chalk rail; however, a single relatively narrow bracket at the center of said rail and chalkboard 10 is usually adequate (FIG. 1). As best shown in FIGS. 2, 3, 4, supporting bracket 50 comprises a pair of coacting angular members or clips 51, 52 adapted to be engaged into and out of nesting relationship.

Clip 51 is L-shaped and has its upright longer arm or leg 53 overlying and secured to the lower margin of the rear surface of board 11 by suitable means such as one of the staples 18. Horizontal arm or leg 55 of this L-shaped clip underlies and engages the underside or bottom of the board. As shown at 57, the upper or free end portion of upright arm 53 of clip 51 above its staple is bent outwardly away from board 11 for flexible movement about an intermediate horizontal axis. Clip 52 is generally J-shaped and has an upright rear or first arm or leg 54 (FIGS. 2-4) an intermediate horizontal second arm or leg 56 extending generally perpendicularly from the lower or inner end of first or rear arm 54 and of less length than the latter, an inclined narrow shorter third arm or leg 58 at the outer end of second arm 56, and an upright outer or front fourth arm or leg 60 at the outer end of third arm 58 in spaced generally parallel relation to said rear or first arm 54. As shown at 62, the outer or free end of fourth arm or leg 60 is rolled or bent arcuately inward upon itself for confinement about hinge pins 30 between flanges or feet 34, 36 of chalk rail 14, whereby clip 52 is supported for pivotal movement with said rail from its disengaged position shown in FIG. 3 to its nesting engagement with L-shaped clip 51 (FIG. 2).

A coextensive flange 64 projects generally perpendicularly inward from the outer end of first arm 54 in parallel relation to second arm 56 and is adapted to engage over the upper end of upright arm 53 of the L-shaped clip. In the latter position, fourth arm 60 of the L-shaped clip is upright and engages the outer end of foot 34 of the chalk rail, second arm 56 is horizontal and underlies horizontal arm 55 of the stationary L-shaped clip in engagement with the underside of rear flange or foot 38 of said chalk rail; and first arm 54 is upright so as to overlie upright arm 53 of said clip 51 for latching engagement of flange 62 with said rail in its extended or horizontal position as shown in FIGS. 2, 4. The bias provided by outward bending of the upper portion 57 of upright arm 53 resists disengagement of this flange from said arm.

Figure 5:
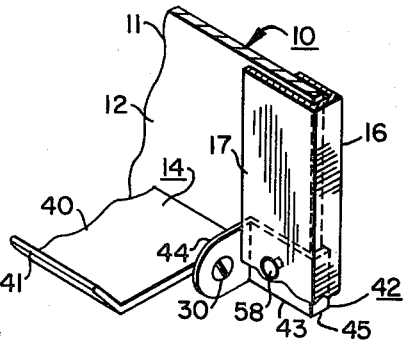

FIG. 5 discloses another embodiment of the invention in which upright hinge mounting flange or plates 44 are formed separately from upright frame members 16 and each flange or plate projects outwardly forwardly from an angular bracket 42 in generally perpendicular relation to the upright flat base or body 43 of each bracket. Base 43 of each bracket is confined between the lower end portions of board 11 and the outer or front longitudinal flange 17 of each frame member, being secured by a fastener or rivet 58. An upright narrow flange 45 extends inwardly or rearwardly from the opposite upright end of each bracket base 43 in generally perpendicular relationship and overlies the upright longitudinal edge portion of the board to prevent pivoting of angular bracket 42. Otherwise, this embodiment may be identical to the embodiment of FIGS. 1-4.

The foregoing description of the invention is explanatory thereof and various changes in the size, shape and materials, as well as in the details of the illustrated construction may be made, within the scope of the appended claims, without departing from the spirit of the invention.

I claim:

1. In a chalkboard having a board presenting an indicia receiving front surface with upright lateral margins, a chalk rail comprising a ledge coextensive with the chalk rail and adjacent the lower margin of the indicia receiving board and of sufficient transverse width to receive markers and erasers, upright flanges projecting perpendicularly from the lower end portions of the upright lateral margins of said board adjacent the ends of said chalk rail, hinge pins rotatably connecting said ends of said rail to the flanges so as to permit pivotal movement of said rail relative to said board, and means for limiting pivotal movement of said rail between an up position folded contiguous and substantially parallel to said board and a down position substantially perpendicular to said board whereby said chalkboard is packagable for shipment in its up position and functions in its down position to provide the supporting ledge, upright frame members at said upright lateral margins of said board, said upright flanges being integral with the lower end portions of the frame members.

2. In a chalkboard having a board presenting an indicia receiving front surface with upright lateral margins, a chalk rail comprising a ledge coextensive with the chalk rail and adjacent the lower margin of the indicia receiving board and of sufficient transverse width to receive markers and erasers, upright hinge members at the lower end portions of the upright lateral margins of said indicia receiving board adjacent the ends of said chalk rail, hinge pins rotatably connecting said ends of said rail to the hinge members so as to permit pivotal movement of said rail relative to said board, means for limiting pivotal movement of said rail between an up position folded contiguous and substantially parallel to said board and a down position substantially perpendicular to said board whereby said chalkboard is packagable for shipment in its up position and functions in its down position to provide the supporting ledge, and angular bracket means mounted at the lower margin of said board intermediate its upright lateral margins and having generally parallel front and rear end portions connected by an intermediate portion generally perpendicular to the end portions, the front end portion of the angular bracket means being attached to the underside of the rear margin of said ledge so as to support said bracket means from said rail for pivotal movement therewith relative to said board, the rear end portion of said angular bracket means being in overlying engagement with the back surface of said board and the intermediate portion of said bracket means being in underlying engagement with the bottom of said board when said rail is in its down position.

3. A chalk rail as defined in claim 2 wherein said angular bracket means includes a pair of coacting angular members, the first of the angular bracket members embodying said generally parallel front and rear end portions and said intermediate portion of said angular bracket means, the second angular bracket member having an upright rear portion overlying and secured to said back surface of said indicia receiving board and a substantially horizontal portion extending forwardly from the lower end of the upright rear portion of said second bracket member so as to underlie said bottom of said board whereby said rear end and intermediate portions of said first bracket member respectively overlie and underlie the upright rear and substantially horizontal portions of said second bracket member when said chalk rail is in its down position.

4. A chalk rail as defined in claim 3 comprising a flange projecting forwardly from the upper end of said upright rear portion of said first angular bracket member for engagement over the upper end of said upright rear portion of said second angular bracket member so as to lock said chalk rail in its aforesaid down position.

5. A chalk rail as defined in claim 4 wherein said upright rear portion of said second angular bracket member above its attachment to said indicia receiving board is bent rearwardly away from said board for engagement with the flange of said first angular bracket member so as to resist disengagement of said flange when said chalk rail is in its down position.

6. A chalk rail as defined in claim 3 wherein the means for limiting pivotal movement of said chalk rail includes a flange extending substantially perpendicularly from the inner margin of said ledge, and a foot projecting generally perpendicularly from the free margin of the flange in spaced substantially parallel relation to said ledge so as to underlie and engage the bottom of said board when said rail is in its down position.

7. A chalk rail as defined in claim 3 wherein said first angular bracket member is generally J-shaped and said second angular bracket member is generally L-shaped.

8. A chalk rail as defined in claim 2 wherein the means for limiting pivotal movement of said chalk rail includes a flange extending substantially perpendicularly from the inner margin of said ledge, and a foot projecting generally perpendicularly from the free margin of the flange in spaced substantially parallel relation to said ledge so as to underlie and engage the bottom of said board when said rail is in its down position.

9. In an indicia receiving board of the type having a substantially planar indicia front surface and an upright lateral margins and a substantially horizontal lower margin, an article supporting rail assembly comprising an elongate ledge member extending longitudinally of the lower margin of the indicia receiving board and of sufficient depth to support indicia affixing and removing articles, means at the lower ends of the upright lateral margins of said board for pivotally connecting the ledge member to said board, means for limiting pivotal movement of said ledge member between a down substantially horizontal position with said member generally perpendicular to said board for supporting articles and an up portion generally parallel to said board so as to reduce the combined thickness of said member and board for packaging, said ledge member being generally coextensive with said lower margin of said board and having an inner longitudinal margin adjacent said board lower margin, the means for limiting pivotal movement of said ledge member having a flange extending substantially perpendicularly from the inner margin said ledge member, and a foot projecting generally perpendicularly from the free margin of the flange in spaced substantially parallel relation to said ledge member so as to underlie and engage the bottom of said board when said rail is in its down position.

10. In an indicia receiving board of the type having a substantially planar indicia front surface and upright lateral margins and a substantially horizontal lower margin, an article supporting rail assembly comprising an elongate ledge member extending longitudinally of the lower margin of the indicia receving board end of sufficient depth to support indicia affixing and removing articles, means at the lower ends of the upright lateral margins of said board for pivotally connecting the ledge member to said board, angular bracket means for limiting pivotal movement of said ledge member between a down substantially horizontal position with said member being generally perpendicular to said board for supporting articles and an up position generally parallel to said board so as to reduce the combined thickness of said member and board for packaging, the angular bracket means being mounted at said lower margin of said board intermediate its upright lateral margins and having generally parallel front and rear end portions connected by an intermediate portion generally perpendicular to the end portions, the front end portion of said angular bracket means being attached to the underside of the rear margin of said ledge member so as to support said bracket means from said ledge member for pivotal movement therewith relative to said board, the rear end portion of said angular bracket means being in overlying intermediate engagement with the back surface of said board and the intermediate portion of said bracket means being in underlying engagement with the bottom of said board when said rail is in its down position.

11. The combination defined in claim 10 wherein said angular bracket means includes a pair of coacting angular members, the first of the angular bracket members embodying said generally parallel front and rear end portions and said intermediate portion of said angular bracket means, the second angular bracket member having an upright rear portion overlying and secured to said back surface of said indicia receiving board and a substantially horizontal portion extending forwardly from the lower end of the upright rear portion of said second bracket member so as to underlie said bottom of said board whereby said rear end and intermediate portions of said first bracket member respectively overlie and underlie the upright rear and substantially horizontal portions of said second bracket member when said chalk rail is in its down position.

12. The combination defined in claim 11 comprising a flange projecting forwardly from the upper end of said upright rear portion of said first angular bracket member for engagement over the upper end of said upright rear portion of said second angular bracket member so as to lock said ledge member in its aforesaid down position.

13. The combination defined in claim 12 wherein the means for limiting pivotal movement of said ledge member comprise a flange extending substantially perpendicularly from the inner margin of said ledge member, and a foot projecting generally perpendicularly from the face margin of the flange in spaced substantially parallel relation to said ledge member so as to underlie and engage the bottom of said board when said rail is in its down position.

14. The combination defined in claim 11 wherein said first angular bracket member is generally J-shaped and said second angular bracket member is generally L-shaped.

* * * * *